US010427270B2

(12) United States Patent
Johnson et al.

(10) Patent No.: US 10,427,270 B2
(45) Date of Patent: Oct. 1, 2019

(54) BELT SANDER ERGONOMIC ARTICULATING ARM BELT WITH BUTTON RELEASE, LOCK, AND SEALED HOUSING

(71) Applicant: INGERSOLL-RAND COMPANY, Davidson, NC (US)

(72) Inventors: Joshua O. Johnson, Allentown, PA (US); Dennis Naksen, Summit, NJ (US); Xizhi Yang, Shanghai (CN)

(73) Assignee: Ingersoll-Rand Company, Davidson, NC (US)

( * ) Notice: Subject to any disclaimer, the term of this patent is extended or adjusted under 35 U.S.C. 154(b) by 262 days.

(21) Appl. No.: 15/283,334

(22) Filed: Oct. 1, 2016

(65) Prior Publication Data

US 2018/0093359 A1 Apr. 5, 2018

(51) Int. Cl.

| | |
|---|---|
| ***B24B 23/06*** | (2006.01) |
| ***B24B 47/12*** | (2006.01) |
| ***B24B 41/04*** | (2006.01) |
| ***B24B 21/20*** | (2006.01) |
| ***B24B 23/02*** | (2006.01) |

(52) U.S. Cl.

CPC ..... *B24B 23/06* (2013.01); *B24B 21/20* (2013.01); *B24B 23/022* (2013.01); *B24B 41/04* (2013.01); *B24B 47/12* (2013.01)

(58) Field of Classification Search

CPC ..... B24B 21/20; B24B 23/02; B24B 23/022; B24B 23/06; B24B 47/12

USPC ..... 451/355

See application file for complete search history.

(56) References Cited

U.S. PATENT DOCUMENTS 1,649,060 A 11/1927 Decker
3,594,959 A * 7/1971 Wezel ..... B24B 21/18 451/311

(Continued)

FOREIGN PATENT DOCUMENTS

RU 2262417 C1 10/2005

OTHER PUBLICATIONS http://www.amazon.com/Belt-Sander-Multipositional-grinding-swivels/dp/B005FMTTQO, Oct. 1, 2016.

(Continued)

*Primary Examiner* — Eileen P Morgan
(74) *Attorney, Agent, or Firm* — Jones IP Group; Wayne A. Jones

(57) ABSTRACT

The belt sander includes a gear casing coupled to a tool housing, the gear casing surrounding one or more gears configured to receive input from a motor to drive a shaft about a drive axis. The belt sander includes a belt arm assembly having a belt arm, the belt configured to translate in response to input from the shaft. The belt sander includes a plurality of incrementally spaced apart receivers on the gear casing and an engagement member in operational communication with the belt arm assembly, the engagement member being movable between a locked position and an unlocked position, wherein in the locked position the engagement member engages a receiver to fix the belt arm assembly incrementally relative to the gear casing, and wherein in the unlocked position the belt arm assembly freely rotates relative to the belt arm assembly to pivot the belt arm about the drive axis.

18 Claims, 7 Drawing Sheets

(56) References Cited

U.S. PATENT DOCUMENTS 3,643,385 A * 2/1972 Mikiya ..... B24B 23/06 451/355
4,334,390 A * 6/1982 Sumerau ..... B24B 23/06 451/355
4,509,296 A * 4/1985 Rasmussen ..... B24B 27/0084 269/74
4,727,685 A * 3/1988 Batt ..... B24B 23/06 451/355
5,031,362 A 7/1991 Reiling et al.
5,168,658 A * 12/1992 Price ..... B24B 23/02 451/311
5,210,981 A * 5/1993 Urda ..... B24B 23/06 451/296
5,235,784 A 8/1993 Oki et al.
5,333,414 A * 8/1994 Lee ..... B24B 23/028 451/355
5,832,611 A * 11/1998 Schmitz ..... B23D 49/11 30/392
6,405,620 B2 6/2002 Liao
6,503,128 B1 * 1/2003 Deware ..... B24B 23/06 451/297
6,671,969 B2 1/2004 Phillips et al.
D508,189 S 8/2005 Murakami
6,916,235 B2 9/2005 Mikiya et al.
6,938,706 B2 9/2005 Ng
7,024,966 B2 4/2006 Chao
7,364,498 B1 * 4/2008 Snyder ..... B24B 21/02 451/296
7,370,423 B1 * 5/2008 Huang ..... A01G 3/065 30/193
7,861,796 B2 4/2011 DeCicco et al.
7,926,585 B2 6/2011 Pozgay et al.
8,454,412 B2 6/2013 Esenwein
8,784,162 B1 * 7/2014 Dovel ..... B24B 3/54 451/303
8,793,886 B2 8/2014 Yamaoka et al.
9,120,202 B2 9/2015 Kelleher et al.
9,156,120 B2 * 10/2015 Kosonen ..... B24B 21/20
2003/0003854 A1 * 1/2003 Deware ..... B24B 23/06 451/59
2014/0220871 A1 * 8/2014 Kosonen ..... B24B 21/20 451/311

OTHER PUBLICATIONS http://www.directindustry.com/prod/dynabrade-europe/product-8306-1216695.html; Oct. 1, 2016.

* cited by examiner

BELT SANDER ERGONOMIC ARTICULATING ARM BELT WITH BUTTON RELEASE, LOCK, AND SEALED HOUSING

BACKGROUND

Technical Field

The present disclosure relates to power tools, and in particular to powered belt sanders.

State of the Art

A belt sander is a type of sander used in shaping and finishing woods, metals, and other materials. The sander consists of a belt, usually comprised of sandpaper or other abrasive material, mounted about a pair of rotating drums, at least one of which rotates in response to powered input. As the belt circulates about the rotating drums, the abrasive material thereon is continuously linearly displaced in one direction, thus causing the abrasive action of traditional sandpaper.

Belt sanders may be portable, wherein the sander is moved over the working material, or may be stationary, wherein the working material is moved to the sanding belt. Stationary sanders, oftentimes called bench sanders when coupled to a stationary support structure, are typically powered by wired electricity, but portable belt sanders may be powered by wired electricity, battery power, pneumatic power, or the like (i.e., power that lends itself to the portable nature of the sander).

Belt sanders may have a belt that is fixed at a position, which may lead to complications in the actual operation of the belt sander, with the user not being able to manipulate the tool to the desired position to have the belt perform the intended operation.

There is thus a need in the power tool industry to provide a means by which the rotating belt of a belt sander can be placed in a desired position of operation.

SUMMARY

The present disclosure relates to power tools, and in particular to powered belt sanders.

An aspect of the present disclosure includes a power tool comprising: a housing containing an internal motor configured to drive a shaft about a drive axis; and a belt arm having opposing rollers with a belt positioned thereon, the belt being configured to translate about the rollers in response to input from the shaft, wherein the belt arm pivots about the drive axis to angle the belt arm at one of a stowed position and a plurality of working positions, and wherein the stowed position is substantially parallel to a grip portion of the housing, and one or more of the plurality of working positions are transverse to the grip portion of the housing.

Another aspect of the present disclosure includes a power tool comprising: a housing containing an internal motor configured to drive a shaft; a belt arm having a belt configured thereon, the belt being configured to translate about the belt arm in response to input from the shaft; wherein the belt arm pivots to angle the belt arm at one of a plurality of predetermined incremental positions with respect to the housing.

Another aspect of the present disclosure includes a power tool comprising: a gear casing coupled to a tool housing, the gear casing surrounding one or more gears configured to receive input from a motor to drive a shaft about a drive axis; a belt arm assembly having a belt arm, the belt configured to translate in response to input from the shaft; a plurality of incrementally spaced apart receivers on the gear casing; and an engagement member in operational communication with the belt arm assembly, the engagement member being movable between a locked position and an unlocked position, wherein in the locked position the engagement member engages one of the plurality of receivers to fix the belt arm assembly incrementally relative to the gear casing, and wherein in the unlocked position the belt arm assembly is free to rotate relative to the belt arm assembly to thereby pivot the belt arm about the drive axis.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

Figure 1:
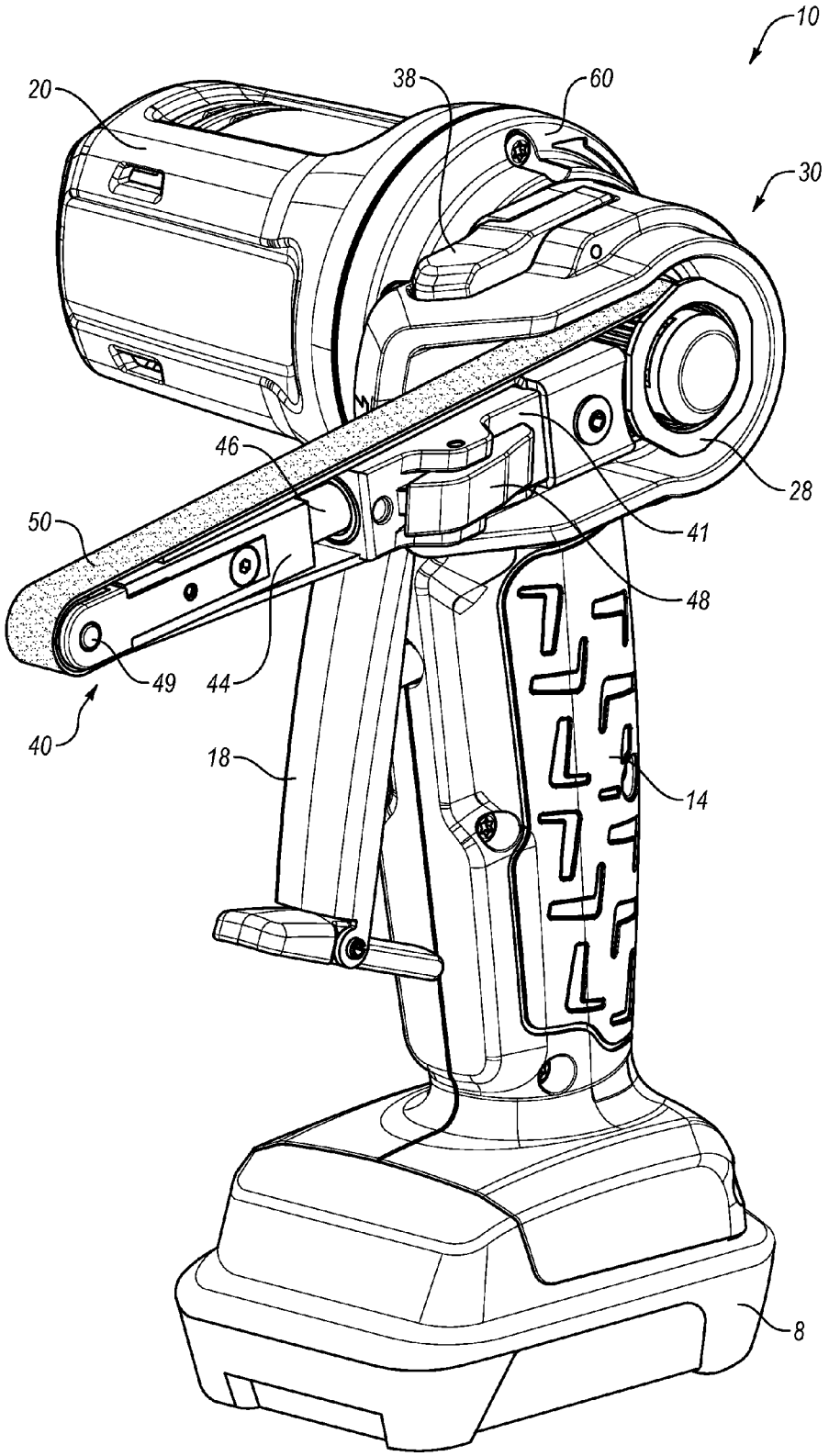
FIG. 1 is a perspective view of an embodiment of a power tool in accordance with the present disclosure.

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

The drawings depict illustrative embodiments of a power tool 10. These embodiments may each comprise various structural and functional components that complement one another to provide the unique functionality and performance of the belt sander 10, the particular structure and function of which will be described in greater detail herein. For example, the power tool 10 may comprise a belt sander having a housing 20, including a grip portion 14, a belt arm assembly 30, a belt arm 40, a belt 50, and a power source 8, among other various components to be described herein.

Figure 2:
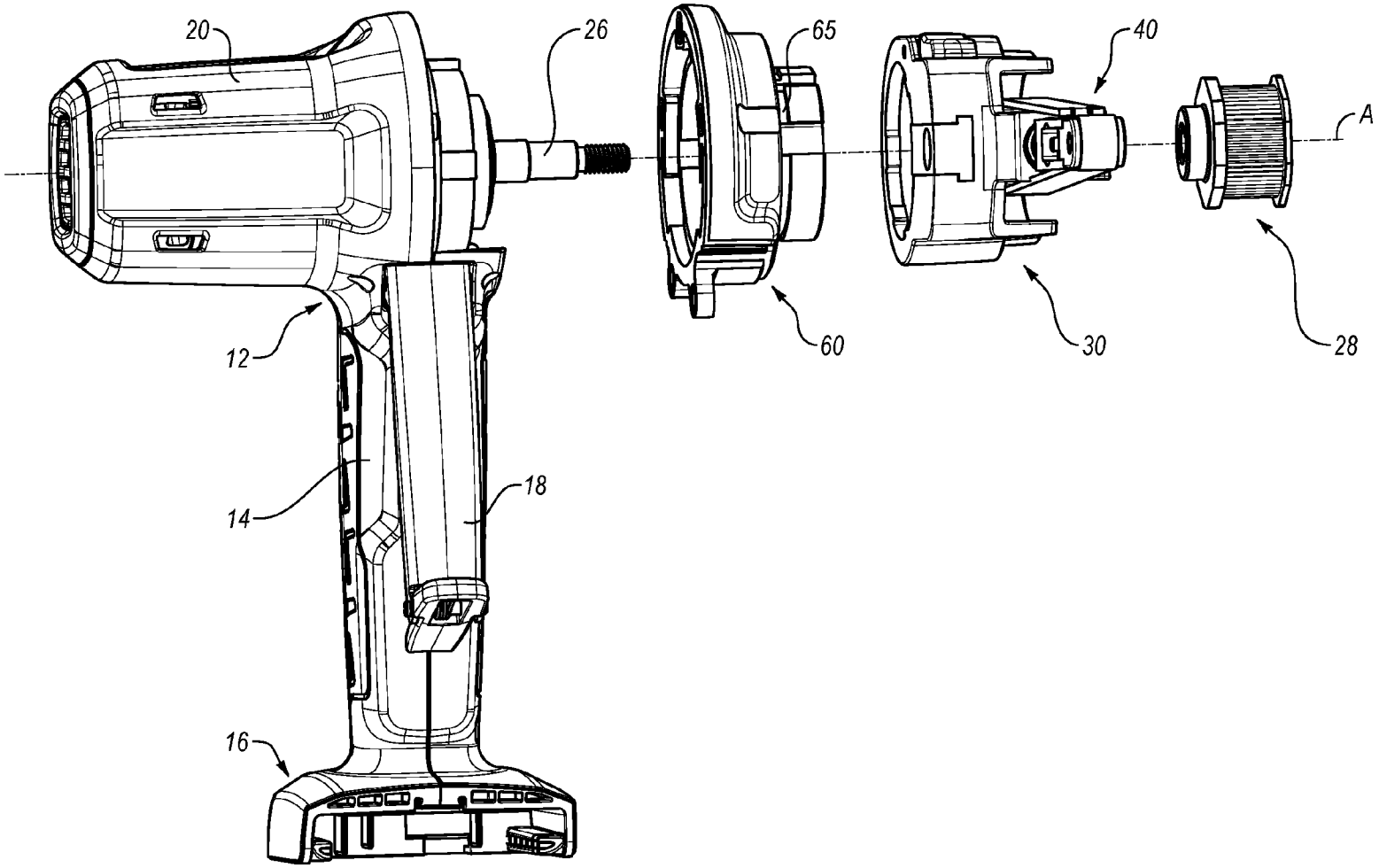
FIG. 2 is an exploded perspective view of an embodiment of a power tool in accordance with the present disclosure.

Referring to the drawings, FIGS. 1 and 2 depict an illustrative embodiment of a power tool 10 in the form of a belt sander. Embodiments of the power tool 10 may comprise a housing 20 that encloses a source of motion, such as, for example, a motor. The motor may be configured to drive a gear mechanism, a tool holder, a drive shaft, or a spindle. Further, the gear mechanism may be configured to receive the input of the motor and translate, reduce, or increase the rotary motion of the motor to the output motion of the tool holder, the drive shaft, or the spindle. Embodiments of the power tool 10 may comprise the motor being configured to drive a shaft 26, either directly or through a gear mechanism, that provides the mechanical output to power or drive the operational aspects of the power tool 10. For example, the motor may be configured to drive the shaft 26 in a rotary motion to drive components of the power tool 10, such as a drive wheel 28 and/or a circulating belt 50 of a belt arm assembly 30, to be described in greater detail herein. Further, the motor may be configured to drive the shaft in a rotary motion about the axis A.

Embodiments of the power tool 10 may comprise a power source 8 that provides power to the motor. The power source 8 may be configured to be detachably coupled to the power tool 10. For example, the power source 8 may be a portable and/or rechargeable power source, such as, for example, a rechargeable battery that may be configured to physically couple to the power tool 10 at a handle or grip portion 14 that extends outwardly from the housing 20. Specifically, the grip portion 14 may have a first end 12 and a second end 16, the first end 12 being coupled to the housing 20 and the second end 16 being configured to have detachably coupled thereto the power source 8. In this way, the power source 8, such as the battery, may electrically drive the motor. Alternatively, the power source 8 may be a hydraulic or pneumatic power source, such as, for example, a high pressure, compressed fluid source (e.g., air compressor or water pump) that may be operatively coupled by hose to the second end 16 of the grip portion 14. In this way, the compressed fluid may pneumatically or hydraulically drive the motor and thereby the operational aspects of the power tool.

Embodiments of the power tool 10 may comprise an actuator 18 that may operatively and selectively couple the power source 8 to the motor. The actuator 18 may be configured to activate a switch (not depicted) for selectively actuating the motor by providing or restricting power thereto, as the case may be. For example, actuating the actuator 18 from a resting state to an engaged state may operatively couple the power source 8 to the motor, and releasing the actuator 18 from the engaged state to the resting state may decouple the power source 8 from the motor. Embodiments of the power tool 10 may further comprise a reversing switch that selectively reverses a direction in which the motor drives the tool holder (i.e., clockwise versus counter-clockwise) or the belt 50 of the belt sander (i.e., forward or backward). As depicted, the power tool 10 may be a battery-powered, cordless belt sander.

Figure 3:
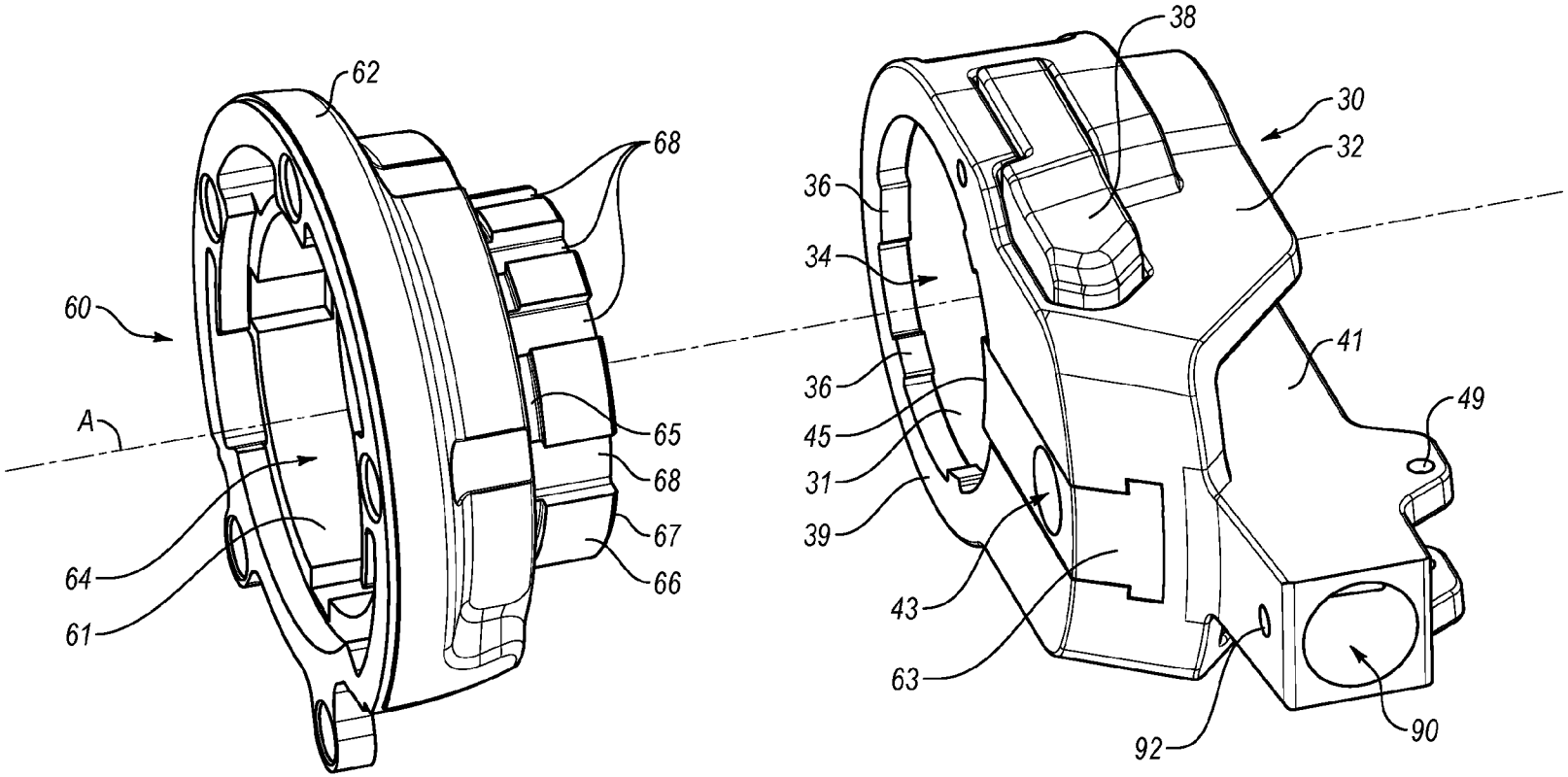
FIG. 3 is an exploded perspective view of component parts of an embodiment of a power tool in accordance with the present disclosure.
Figure 4:
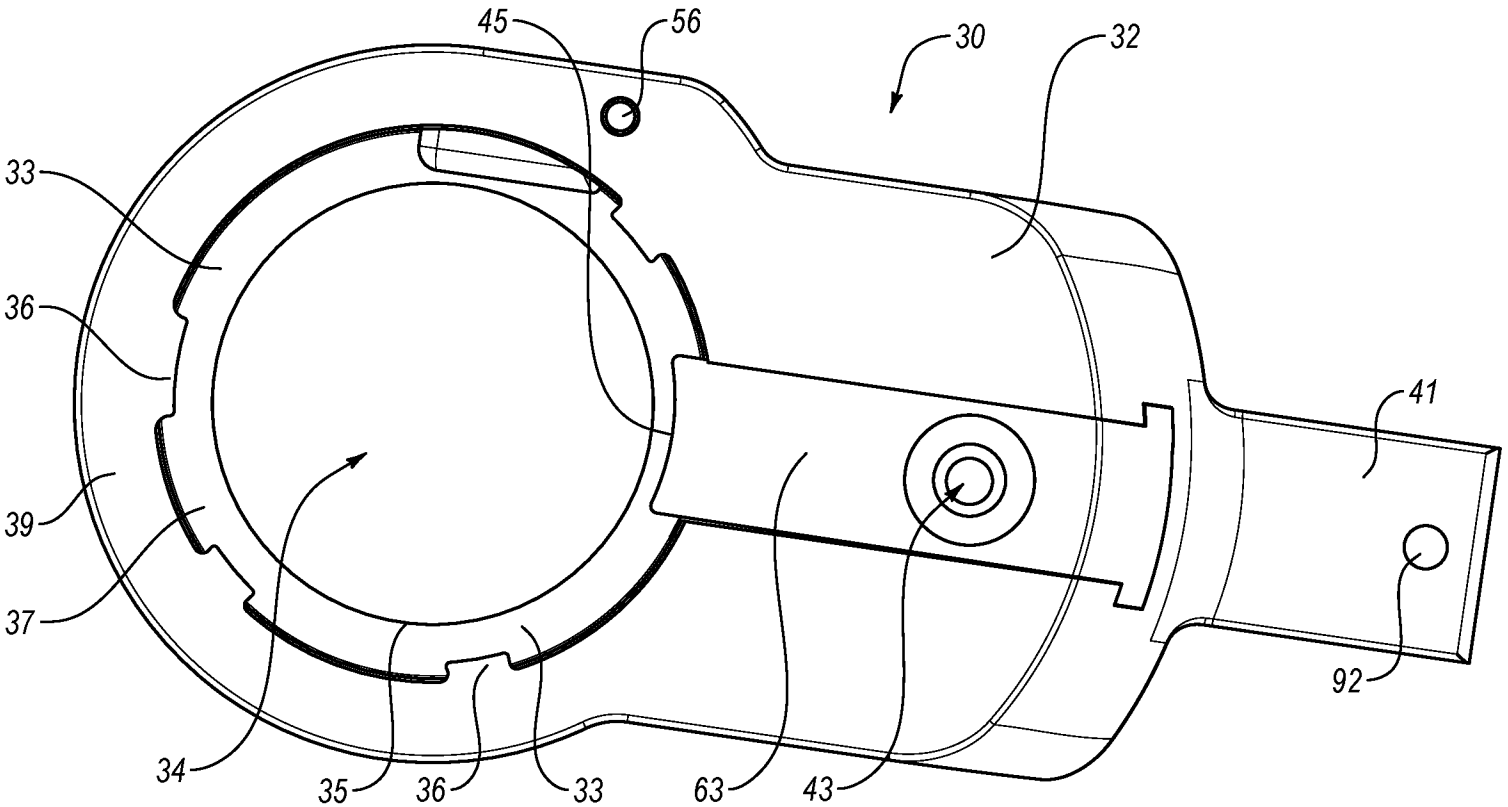
FIG. 4 is a side view of a component part of an embodiment of a power tool in accordance with the present disclosure.
Figure 5:
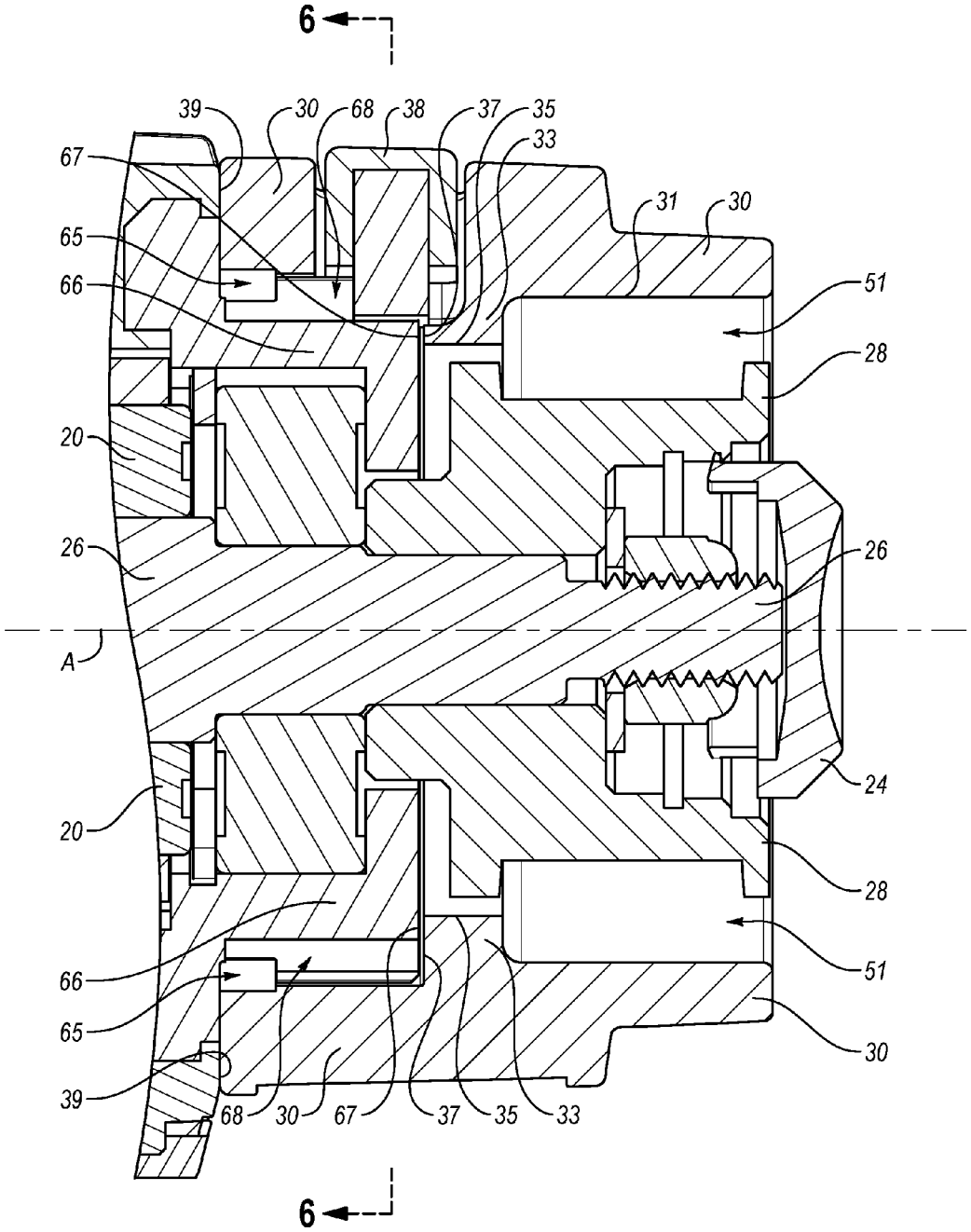
FIG. 5 is a cross sectional view of component parts of an embodiment of a power tool in accordance with the present disclosure.

With reference to FIGS. 3-5, embodiments of the power tool 10 may comprise a belt arm assembly 30. The belt arm assembly 30 may comprise an assembly body 32 having a bore 34 positioned therein. The bore 34 may have an interior surface 31. The bore 34 may run entirely through the assembly body 32 such that the bore 34 may be a through-bore that is open to opposing sides of the assembly body 32. One of the opposing sides of the assembly body 32 may have a face 39. Embodiments of the power tool 10 may comprise the interior surface 31 having a flange 33, the flange 33 being positioned in the bore 34 somewhere between the opposing sides of the assembly body 32 and extending radially inward from the interior surface 31 so as to rise up off of the interior surface 31 and project toward the center of the bore 34, or toward the axis A. The flange 33 may be configured to have a first face 35 and a second face 37. The first face 35 and the second face 37 may be positioned orthogonally to one another. For example, the first face 35 may have an axially oriented surface, whereas the second face 37 may have a radially oriented surface. The first face 35 may be configured to be oriented substantially in parallel with the interior surface 31 and the second face 37 may be configured to be oriented substantially in parallel with the face 39 of the assembly body 32.

Embodiments of the power tool 10 may further comprise a belt arm 40. The belt arm 40 may be configured to cooperate with the belt arm assembly 30 to position the belt 50 with respect to the housing 60 and/or the axis A. The belt arm 40 may be further comprised to cooperate with a drive roller or drive wheel 28 to drive the belt 50 about the belt arm 40. The belt arm 40 may be configured to establish and maintain pressure upon the belt 50 once the belt 50 is positioned on the belt arm 40, such that as the belt 50 articulates about or around the belt arm 40, a user may utilize the rotating belt 50 to perform work on a workpiece. The belt arm 40 may be further configured to be releasably coupled to the belt arm assembly 30, or at least one or more portions of the belt arm 40 may be configured to be releasably coupled to the belt arm assembly 30.

Embodiments of the belt arm 40 may comprise an assembly arm 41. The assembly arm 41 may be configured to be coupled to the assembly body 32, or, in the alternative, the assembly arm 41 may be configured as an integral component with the assembly body 32. The assembly arm 41 may be configured to extend from the assembly body 32, such that the assembly arm 41 may extend radially away from the assembly body 32. For example, the assembly arm 41 may be configured to extend away from the assembly body 32 and transversely to the axis A, and in some cases substantially orthogonally away from the axis A. Embodiments of the belt arm assembly 30 may comprise the assembly arm 41 being configured to extend from the side of the assembly body 32 opposite that of the face 39, as depicted in FIG. 3.

Embodiments of the assembly arm 41 may further comprise a hole 90 therein. The hole 90 may be oriented in the assembly arm 41 to have an axis substantially in parallel with a length of the assembly arm 41. In such an orientation, the hole 90 may define an opening in a distal end of the assembly arm 41, as depicted in FIG. 3. The assembly arm 41 may further comprise a locking feature 92 and a pivot 94. The locking feature 92 may be configured to communicate with a belt tensioner 44 to establish functional engagement and/or physical contact at least between the assembly arm 41 and the belt tensioner 44. On the other hand, the pivot 94 may be configured to cooperate with a belt release 48. The belt release 48 may be configured to operate to allow the belt 50 to be released from and inserted onto the belt arm 40. In other words, operation of the belt release 48 may function to permit the belt 50 to be inserted onto or removed from the belt arm 40 of the power tool 10. In this way, the belt 50 may be replaceable, interchangeable, disposable, reusable, consumable, substitutable, repairable, expendable on the power tool 10, as the case may be and/or as needed. As the belt release 48 is operated, the belt release 48 may be configured to pivot about the pivot 94 between a locked position and an unlocked position. In the locked position, the belt release 48 may function to secure the belt 50, directly or indirectly, to the belt arm 40. Conversely, in the unlocked position, the belt release 48 may function to allow the belt 50, directly or indirectly, to be released from the belt arm 40.

Embodiments of the belt arm 40 may comprise a belt tensioner 44. The belt tensioner 44 may be configured to cooperate with the assembly arm 41 to provide tension force to the operation of the belt 50 on the power tool 10. For example, the belt tensioner 44 may comprise a rod 46 that communicates with the hole 90 of the assembly arm 41. The rod 46 may be inserted within the hole 90 and be configured to move axially within the hole 90. The rod 46 may be configured to cooperate with a biasing member (not depicted) that is also inserted within the hole 90 but may be positioned between the rod 46 and the assembly arm 41, such that the biasing member may function as a shock absorber as well as a piston to the belt tensioner 44. In other words, when a compressive force is exerted on the belt tensioner 44, the biasing member may serve to help absorb the compressive force. Yet, the biasing member may also exert an axial force to push the belt tensioner 44 out of the hole 90, but obviously only to the degree permitted by the size of the belt 50 so as to keep tension on the belt 50. To that end, the belt tensioner 44 may further comprise a roller 49 positioned on an opposite end of the belt tensioner 44 from the rod 46 and thus positioned proximate a distal end of the belt arm 40. The roller 49 may serve to permit the belt 50 to circulate thereabout in response to the input of the drive wheel 28, to be described herein.

Embodiments of the power tool 10 may comprise the belt 50 being adapted to be releasably coupled to the belt arm 40. For example, a bushing (not depicted) may be configured to be inserted within the hole 90 and communicate not only with the biasing member and the belt tensioner 44, but also with the belt release 48. For example, depression of the belt release 48 may place the belt release in the unlocked position and allow the bushing to axially advance or retract within the hole 90 to permit the rod 46 to follow and thus the roller 49 to follow to allow the belt 50 the adequate space, distance, length, and/or room to be inserted onto or removed off of the roller 49 to remove or add the belt 50 to the belt arm 40. Likewise, when the belt release 48 is not actuated the belt release 48 may be biased in the locked position to maintain the position of the bushing within the hole 90 to maintain the position of the belt tensioner 44 and thus the roller 49 with respect to the assembly arm 41 to maintain adequate tension on the belt 50.

Embodiments of the power tool 10 may comprise the belt arm 40, or at least portions thereof, being removable from the power tool 10. For example, the belt tensioner 44 may be releasably coupled to the assembly arm 41. While operation of the belt release 48 may allow the belt tensioner 44 to axially retreat within the hole 90 (i.e., the rod 46 may axially retreat into the hole 90) to thereby release the tension on the belt 50 for removal of the belt 50 from the belt arm 40, operation of the locking feature 92 may allow the belt tensioner 44 to be completely removed from out of the hole 90 (i.e., the rod 46 may be removed from out of the hole 90). The locking feature 92 may be a button, lever, device, key, switch, control, quick-release mechanism, screw, bolt, or other similar locking engagement or mechanism that permits engagement of the locking feature 92 with the interior of the hole 90 and the components housed therein, such as the bushing and/or the rod 46. For example, the locking feature 92 may be a screw that may interact with the bushing and/or the rod 46 to prevent the bushing and/or the rod 46 from being completely removed from the hole 90. With the locking feature 92 engaged with the bushing and/or the rod 46, the belt tensioner 44 is maintained in operational and functional contact with the assembly arm 41, as described herein. For example, when the locking feature 92 is engaged with the bushing and/or the rod 46, the belt tensioner 44 may be allowed to axially advance or retreat with respect to the assembly arm 41 in response to actuation of the belt release 98, as well as the force of the user and/or the biasing member, as needed, to adjust/remove the belt 50 from the belt arm 40, but may at the same time be prevented from fully retreating out of the hole 90 and being completely removed from the assembly arm 41. In other words, with the locking feature 92 in the engaged position, the belt tensioner 44 may be prevented from being completely removed from the assembly arm 41, but may nevertheless allow the belt tensioner 44 to be axially adjustable with respect to the assembly arm 41 to allow the belt 50 to be easily and efficiently inserted or removed from the belt arm 40.

On the other hand, when the locking feature 92 is in the unengaged position, the bushing and/or the rod 46 may be allowed to be completely removed from within the hole 90, to thereby allow the belt tensioner 44 to be completely detached from the assembly arm 41. In some embodiments, with the locking feature 92 in the unengaged position, the belt release 98 may also need to be operated to the unlock position to allow the bushing, rod 46, and belt tensioner 44 to be completely removed from the assembly arm 41. However, the belt release 98 need not be completely detached from the pivot 47 or the assembly arm 41 to permit the detachment of the belt tensioner from the assembly arm 41. By permitting the belt tensioner 44 to be detachable from the assembly arm 41, the power tool 10 is adaptable to have different sized belt tensioners 44 attached thereto, as needed for different work purposes or for different work pieces. Moreover, by having the belt tensioner 44 detachable from the assembly arm 41, the repair and replacement of parts is easier and more efficient. For example, with the advantages of the present disclosure, as described herein, instead of needing to replace the entire belt arm assembly 30 due to a broken belt tensioner 44, only the belt tensioner 44 need be replaced, thus saving cost. Or, an additional advantage is that the belt tensioner 44 may be removed/replaced without having to also remove the belt release 48 from the assembly arm 41.

Embodiments of the power tool 10 may further comprise a drive roller or a drive wheel 28. The drive wheel 28 may be a cylindrical member with a bore, the bore having more than one interior diameter, one diameter to receive and engage the shaft 24 and another diameter to accommodate a securing member 24, to be described in greater detail. As mentioned, the drive wheel 28 may be configured to operatively couple, or to be operatively coupled, to the shaft 26. In this way, as the shaft 26 rotates in response to input from the motor, the drive wheel 28 may likewise rotate in response to input from the shaft 26. The drive wheel 28 may be configured to receive thereon a belt 50, or at least a portion of the belt 50. The drive wheel 28 may be further configured to grip the belt 50 or, at the minimum, to engage the belt 50 to drive the belt 50 in the direction of rotation of the drive wheel 28. The belt 50 may be a continuous belt having no beginning and no end.

Embodiments of the power tool 10 may further comprise the belt arm assembly 30 being configured to receive therein the drive wheel 28. For example, the bore 34 of the belt arm assembly 30 may be configured to have a size and shape consistent with, or at least cooperative with, the size and shape of the drive wheel 28. Further, the belt arm assembly 30 may be configured to permit the drive wheel 28 to rotate within the bore 34, or at least a portion of the bore 34. Moreover, the belt arm assembly 30 may be configured of a size and shape to create a gap 51 between the interior surface 31 of the bore 34 and the exterior surfaces of the drive wheel 28. The gap 51 may be configured to permit the movement or rotation of the belt 50 about the drive wheel 28 without the belt 50 contacting the belt arm assembly 30.

Embodiments of the power tool 10 may comprise the drive wheel 28 being configured to cooperate with the belt arm 40. For example, the drive wheel 28 may be coupled to the shaft 26 and situated within the belt arm assembly 30 in such a way that the drive wheel 28 may line up with the assembly arm 41 and the belt tensioner 44. This configuration may allow the belt 50 to rotate about the drive wheel 28 (in response to input from the drive wheel 28, as described above), to move along a length of the assembly arm 41 and belt tensioner 44, to rotate about the roller 29, to move back along the length of the assembly arm 41 and belt tensioner 44, on an opposing side of each of the assembly arm 41 and belt tensioner 44, and return to the drive wheel 28, only to repeat the process over and over again. With the belt 50 being a continuous belt, the belt 50 may be stretched onto, or otherwise positioned over, the drive wheel 28 on one end and the roller 29 on the other end, such that the belt 50 may be positioned on the belt arm 40 and rotated or driven about the belt arm 40 by the drive wheel 28. The belt arm 40 therefore provides the desired and required structure and rigidity to the belt 50, such that the user or operator of the power tool 10 may utilize the belt 50, and more specifically the rotating movement of the belt 50, to perform work on a workpiece.

Embodiments of the power tool 10 may comprise a gear casing 60. The gear casing 60 may have may comprise a gear casing body 62 having a bore 64 positioned therein. The bore 64 may have an interior surface 61. The bore 64 may run entirely through the gear casing body 62 such that the bore 64 may be a throughbore that is open to opposing sides of the gear casing body 62. One of the opposing sides of the gear casing body 62 may have an extension 66 protruding therefrom in an axial direction. The remaining opposing side may be configured to abut the housing 20. Embodiments of the power tool 10 may comprise the gear casing 60 being configured to be coupled, or even releasably coupled, to the housing 20 with the shaft 26 positioned within the bore 64. Fasteners, such as screws, rivets, bolts, or the like, may be utilized to couple the gear casing 60 to the housing 20.

Embodiments of the power tool 10 may comprise the extension 66 having indentations 68 therein. The indentations 68 may be configured to extend inward in a radial direction to create slots, divots, grooves, and/or channels in the outer surface of the extension 66. Moreover, the indentations 68 may extend through the axial length of the extension 66, such that the indentations 68 may be open to the distal end 67 of the extension 66. The indentations 68 may be considered receivers to receive an object therein. Embodiments of the power tool 10 may comprise the indentations 68 being configured to have a particular size and shape, and in some embodiments may be all of the same size and shape. In alternative embodiments, some of the indentations 68 may have a particular size and shape, whereas other of the indentations 68 may have a different particular size and shape. In alternative embodiments, many of the indentations 68 may have a particular size and shape, whereas one of the other of the indentations 68 may have a different particular size and shape. Further, the indentations 68 may be spaced about the circumference of the extension 66. For example, the indentations 68 may be incrementally or periodically spaced about the circumference of the extension 66 in an interval-type pattern. Embodiments may include some of the indentations 68 being spaced at a particular interval pattern, whereas some others of the indentations 68 may be spaced at a different particular pattern. Alternative embodiments may include most of the indentations 68 being spaced about the circumference of the extension 66 in a particular interval pattern, while one of the indentations 68 may be spaced apart in its own unique pattern. Such a configuration may provide that the belt assembly arm 30 may move and be positioned in a particular fashion with respect to the housing 20, the axis A, and/or the gear casing 60, as will be described in greater detail herein.

With reference to FIGS. 2 and 5, embodiments of the power tool 10 may comprise the extension 66 having a recess 65. The recess 65 may be positioned proximate to the location where the extension 66 extends, or otherwise protrudes, from the gear casing body 62. The recess 65 may have an axial width and run about some or all of the circumference of the extension 66. The recess 65 may therefore be positioned on the extension 66 closer to the gear casing body 62 than the distal end 67 of the extension 66.

Figure 6:
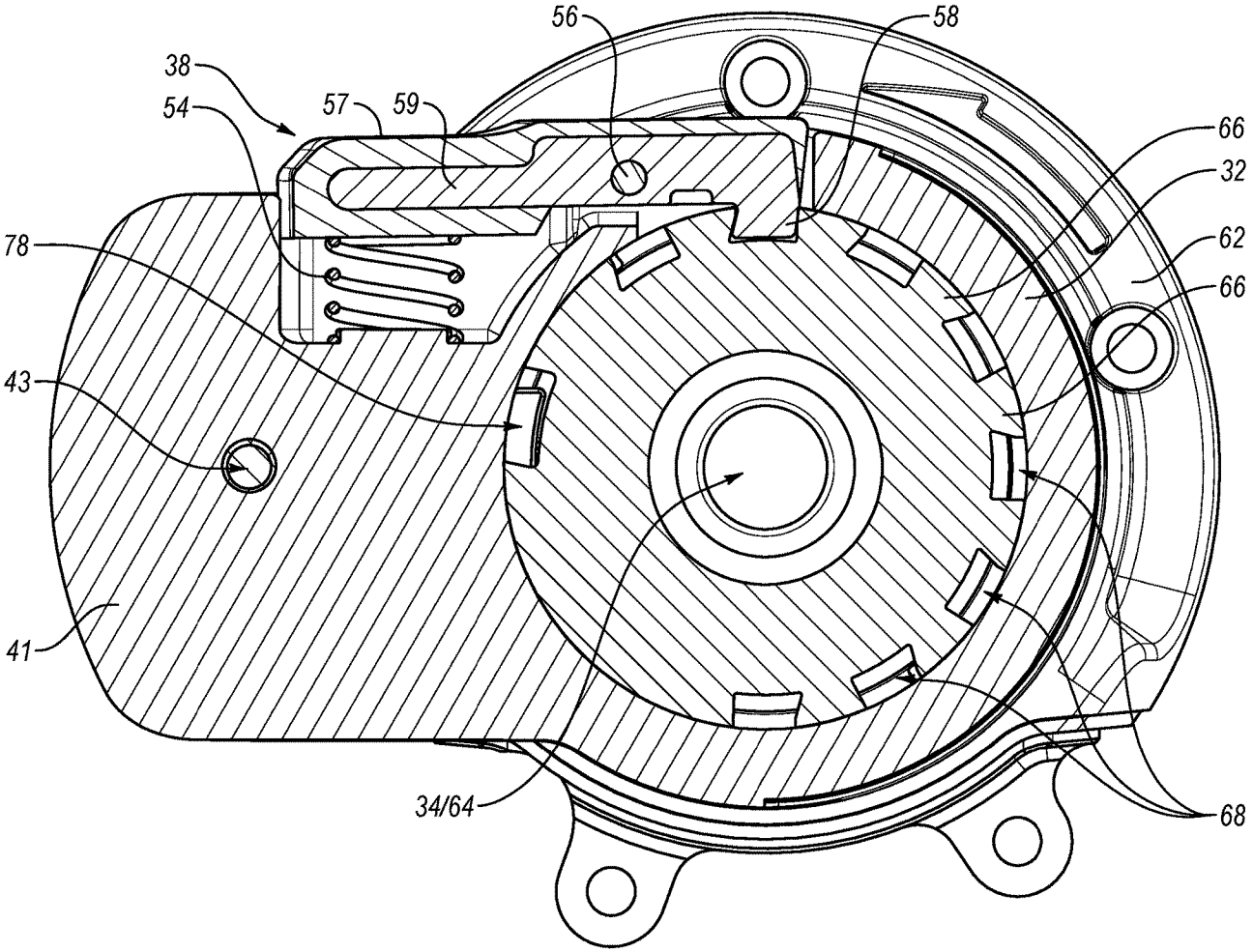
FIG. 6 is a cross sectional view of component parts of the embodiment of a power tool from the line F6 in FIG. 5 in accordance with the present disclosure.

With reference to FIGS. 2, 5 and 6, embodiments of the power tool 10 may comprise the extension 66 having a size and shape consistent with, or at least cooperative with, the bore 34 of the belt arm assembly 30. For example, the belt arm assembly 30 may be configured to be inserted onto the extension 66 so that the interior surface 31 of the belt arm assembly 30 may engage, or otherwise contact, the extension 66. Moreover, with the belt arm assembly 30 positioned on the extension 66, the shaft 26 may be positioned within the bore 34 and extend through the bore 34.

Embodiments of the power tool 10 may comprise the interior surface 31 of the belt arm assembly 30 further comprising a lip 36. The lip 36 may reside on, and protrude radially inward from, the interior surface 31. The lip 36 may be configured to be inserted into, or otherwise engaged with, a corresponding indentation 68 on the extension 66, when the belt arm assembly 30 is to be positioned on the gear casing 60. For example, aligning the lip 36 with the corresponding indentation 68 may provide that the bore 34 of the belt arm assembly 30 may slidably engage the extension 66 of the gear casing 60, such that the extension 66 may reside within, or at least partially within, the bore 34. In this engagement, the belt arm assembly 30 may be configured to spin about or rotate with respect to the gear casing 60, the housing 20, or the axis A. Further, in this slideable engagement, the lip 36 may further be positioned and configured to engage the recess 65 as the belt arm assembly 30 is rotated or spun. The lip 36 and the recess 65 may thus be configured to retain the belt arm assembly 30 and the gear casing 60 with respect to one another, even during rotational motion therebetween.

With reference to FIGS. 3 and 4, embodiments of the power tool 10 may comprise a key 63. The key 63 may be configured to functionally engage the gear casing 60 and the belt arm assembly 30 with one another, such that when properly configured the key 63 may prevent the disengagement of the gear casing 60 from the belt arm assembly 30. For example, the key 63 may be a member body that is slidably engageable with the belt arm assembly 30. The key 63 may be inserted within a hollow of the belt arm assembly 30 that is specifically sized and suited to receive therein the key 63. With the key 63 properly inserted within the hollow, the key 63 may be in a locked position that serves to lock the gear casing 60 and the belt arm assembly 30 with one another. On the other hand, with the key 63 removed from within the hollow, the key 63 may be in an unlocked position that allows the gear casing 60 and the belt arm assembly 30 to be removed or decoupled from one another. To insert the belt arm assembly 30 onto the gear casing 60, as described herein, the key 63 may be in the unlocked position. Then, with the belt arm assembly 30 properly configured on the extension 66 of the gear casing 60, the key 63 may be inserted within the hollow of the belt arm assembly 30. By advancing the key 63 completely within the hollow, the distal end of the key 63 is situated to create or establish a lip 45 that extends into the bore 34 of the belt arm assembly 30. The advantage of the lip 45 extending into the bore 34 is that with the belt arm assembly 30 engaged on the extension 66, the lip 45 may be configured and positioned to functionally engage and/or physically contact the recess 65 on the extension 66. Thus, the lip 45 may be situated within the recess 65 to allow rotation of the belt arm assembly 30 about the axis A, but at the same time prevent axial advancement or retreat of the belt arm assembly 30 away from the gear casing 60. In other words, the configuration of the lip 45 within the recess 65 may allow the belt arm assembly 30 to rotate with respect to the gear casing 60 while at the same time maintaining the axial positioning of the belt arm assembly 30 with the gear casing, as described herein. Further, the key 63 may comprise an engagement bore 43 that allows the key 63 to be secured to the belt arm assembly 30 to prevent the key 63 from unwittingly, unintentionally, or accidentally retreating out of position once established. The engagement bore 43 may allow a fastener to fasten the key 63 to the belt arm assembly 30.

Embodiments of the power tool 10 may comprise the drive wheel 28 being inserted within the bore 34 and onto or over the shaft 26, such that the shaft 26 may be exposed through the bore of the drive wheel 28. Also, the drive wheel 28 may be configured to engage portions of the gear casing 60 or the housing 20, and, as described above, the drive wheel 28 may be configured to engage portions of the shaft 26. Embodiments of the power tool 10 may comprise the drive wheel 28 not coming into contact with the belt arm assembly 30, but remaining free thereof. As for the shaft 26 through the bore of the drive wheel 28, the exposed portions of the shaft 26 may comprise a threaded surface that may be configured to receive a securing member 24 thereon. The securing member 24 may be configured to engage the shaft 26 to thereby secure the gear casing 60, the belt arm assembly 30, and the drive wheel 28 on the shaft 26 of the power tool 10, as well as with respect to one another. Alternative embodiments may comprise the securing member 24 being configured to engage the shaft 26 to thereby secure the gear casing 60 and the drive wheel 28 on the shaft 26 of the power tool 10, as well as with respect to one another. As such, the belt arm assembly 30 may be engaged with the gear casing 60 to thereby secure the belt arm assembly 30 to the power tool 10.

With the belt arm assembly 30 positioned on the power tool 10, as described above, and engaged with the gear casing 60, the face 39 of the belt arm assembly 30 may be configured to abut, or otherwise contact, the gear casing body 62. In this way, there may be no spacing between the gear casing 60 and the belt arm assembly 30, as depicted in FIG. 5. In other words, the face 39 of the assembly body 32 may be flush with the gear casing body 62 of the gear casing 60.

Also, with the belt arm assembly 30 positioned on the power tool 10, as described above, and engaged with the gear casing 60, the gap 51 may be defined as the interior space between the drive wheel 28 and the interior surface 31 of the belt arm assembly 30. For example, the drive wheel 28 may comprise opposing rims on opposite distal ends. These opposing rims may assist the belt 50 to remain on the drive wheel 28 and in position over the belt arm 40 as the belt 50 is rotated about the drive wheel 28. The gap 51 may therefore provide ample spacing for the belt 50 to traverse about the drive wheel 28 and over the belt arm 40, without the belt 50 contacting the belt arm assembly 30.

Also, with the belt arm assembly 30 positioned on the power tool 10, as described above, and engaged with the gear casing 60, the flange 33 of the belt arm assembly 30 may be brought into position with respect to the gear casing 60 and the drive wheel 28. For example, the first face 35 of the flange 33 may be positioned proximate to and in opposition to one of the opposing rims of the drive wheel 28, such that there is very little space, if any, between the first face 35 and the interior rim of the drive wheel 28. Because the flange 33 extends further radially into the bore 34, the first face 35 of the flange 33 is brought closer to the opposing rim of the drive wheel 28. Such configurations provide that dust, powder, dirt, debris, particles, and the like, are prevented or discouraged from entering between the belt arm assembly 30 and the interior rim of the drive wheel 28. This is advantageous because contaminants, such as dirt and the like, that may damage, hinder, disturb, and/or prevent the normal or desired operation of the power tool 10 are deterred from doing so. Similarly, the second face 37 of the flange 33 may be positioned proximate to the distal end 67 of the extension 66, such that the second face 37 may be in direct contact with the distal end 67 to establish a flush engagement with the distal end 67. Embodiments of the power tool 10 may comprise the second face 37 having a dimension that corresponds to the dimension of the distal end 67. For example, the distal end 67 may have a radial length and the second face 37 may be configured to have a corresponding radial length. At the very least, embodiments of the power tool 10 may comprise an overlap between the distal end 67 of the extension 66 and the second face 37 of the belt arm assembly 30, the overlap defining physical contact between the distal end 67 and the second face 37. Such configurations provide that dust, powder, dirt, debris, particles, and the like, are prevented or discouraged from entering between the belt arm assembly 30 and the extension 66. This is advantageous because contaminants, such as dirt and the like, that may damage, hinder, disturb, and/or prevent the normal or desired operation of the power tool 10 are deterred from doing so. At least, the contaminants are discouraged from passing beyond the engagement of the second face 37 and the distal end 67 to pass beyond the gear casing 60 and enter into the gears or the motor to disrupt the operation thereof.

Embodiments of the power tool 10 may comprise an actuator, switch, button and/or control 38. The control 38 may be configured to cooperate with the belt arm assembly 30, as well as with the gear casing 60. For example, the control 38 may be coupled to the belt arm assembly 30 at a pivot point 56. The pivot point 56 may allow the control 38 to pivot between one or more positions. For example, the control 38 may operate between a first position, such as an engaged or locked position, and a second position, such as an unengaged or unlocked position. The control 38 may be further configured to be biased in one of the first or second positions. For example, the control 38 may be configured to receive the biased input of a biasing member 54, such as a spring or the like. As depicted, the biasing member 54 may apply a biasing force against the control 38 to position, or otherwise bias, the control in one of the first or second positions.

The control 38 may further comprise an engagement member 58, such as a tooth, tine, projection, and/or cog that extends from the control 38. The engagement member 58 may be positioned on an opposing side of the control 38 from the point of contact between the biasing member 54 and the control 38. Or, in other words, the biasing member 54 and the engagement member 58 may be on opposite sides of the pivot point 56. As such, when the when the control 38 transitions between the first and second positions, the engagement member 58 may also move between first and second positions. Or in other words, as the control 38 pivots about the pivot point 56, the engagement member 58 may rise up and down, move in or out, or the like.

The engagement member 58 may also be sized and shaped to correspond to and cooperate with the indentations 68 in the extension 66. As a result, the engagement member 58 and the corresponding indentations 68 may function to establish, direct, control, or otherwise govern the rotational communication between the belt arm assembly 30 and the gear casing 60. For example, the engagement member 58 may be inserted within one of the indentations 68. Doing so may lock or fix the positional relationship between the belt arm assembly 30 and the gear casing 60. In contrast, releasing the engagement member 58 from out of the indentation 68 may free the belt arm assembly 30 to rotate, spin, or turn with respect to the gear casing 60. For example, the biasing member 54 may bias the engagement member 58 in one of the indentations 68 so as to fix the positioning between the belt arm assembly 30 and the gear casing 60, such that the belt arm assembly 30 does not rotate, spin, or otherwise move with respect to the gear casing 60. Thereafter, if it is desired to rotate the belt arm assembly 30, and thus the orientation of the belt arm 40 coupled to the belt arm assembly 30, force may be applied to the control 38 at the point 57 to overcome the biasing force of the biasing member 54 to pivot the control 38 about the pivot point 56 and cause the engagement member 58 to release from the indentation 68. Such release allows the interior surface 31 of the belt arm assembly 30 to freely rotate about the exterior surface of the extension 66. Thereafter, once a desired orientation between the belt arm assembly 30 and the gear casing 60 has been established, the force applied to the control 38 at the point 57 may be released, thus allowing the biasing member 54 to exert biasing force against the control 38 to pivot the control 38 about the pivot point 56 to cause the engagement member 58 to catch or engage with the corresponding indentation 68. In this way, operation of the control 38 may permit the locking and unlocking of the belt arm assembly 30 with respect to the gear casing 60 in rotation about the axis A.

Figure 7:
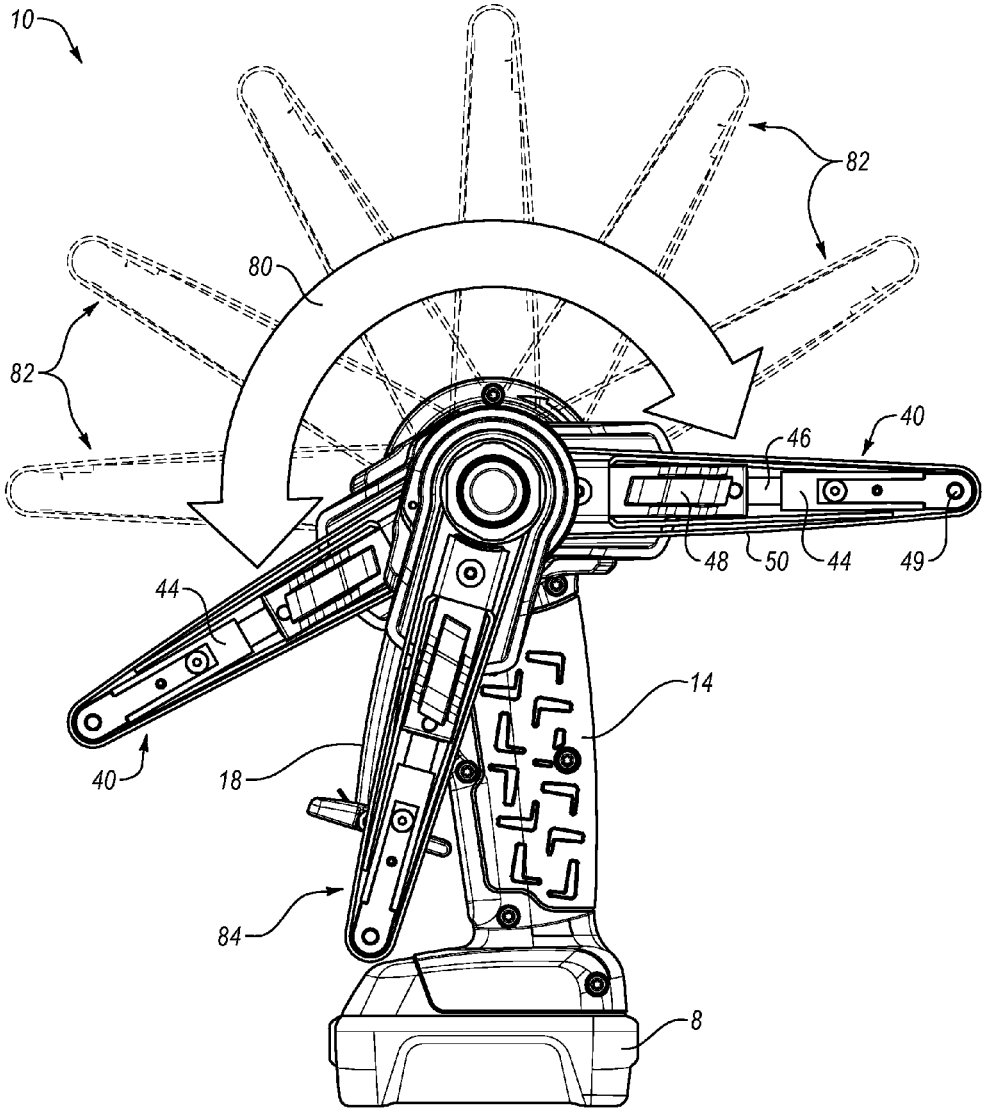
FIG. 7 is side perspective view of the embodiment of a power tool from FIG. 1 in accordance with the present disclosure.

With reference to FIGS. 6 and 7, indentations 68 may be positioned in the extension 66 in such locations so as to position the belt arm 40 with respect to the housing 20, and in particular with the grip portion 14 and actuator 18. For example, an indentation 68 may be positioned in the extension 66 to permit the belt arm assembly 30 to be positioned about the axis A and thereafter locked such that the belt arm 40 may be positioned substantially in parallel with the grip portion 14, substantially proximate the grip portion 14, substantially in parallel with the actuator 18, or substantially between the actuator 18 and the grip portion 14 (such that when viewed from the side, as in FIG. 7, the belt arm 40 and the belt 50 are within the boundary defined by the actuator 18 and the grip portion 14). In this position, the belt arm 40 may be considered in a stored position 84, such that the power tool 10 may be transported to and fro without the belt arm 40 snagging or catching on things.

Further, as depicted in FIG. 7, the belt arm assembly 30 may be rotated such that the belt arm 40 may be positioned at one or more operating positions 82. The operating positions 82 may be positions between 8 and 3 o'clock, as depicted in FIG. 7. However, the operating positions 82 may be any number of incremental positions about a full 360-degree rotation, either forward or backward in the direction arrow 80, with respect to the gear casing 60, housing 20, and/or axis A. In other words, embodiments of the power tool 10 may further comprise the indentations 68 being strategically positioned on the extension 66 to permit a full range of motion for the belt arm assembly 30 about the axis A. Further, embodiments of the power tool 10 may further comprise the indentations 68 being strategically positioned on the extension 66 to provide a custom degree of rotation. Thus, by altering or positioning the indentations 68 about the extension 66 and adapting the engagement member 58 to correlate therewith, any number of configurations could be set forth for the rotation and positioning of the belt arm assembly 30 with respect to the gear casing 60 and/or the axis A.

As set forth above, with the belt arm assembly 30 in the locked position, a user may utilize the belt 50 to work on the workpiece. With the belt arm assembly 30 in the unlocked position, a user may rotate or pivot the belt arm assembly 30 about the axis A to position or angle the belt arm 40, and thus the belt 50, at the desired operational angle with respect to the gear casing 60, housing 20, and grip portion 14. Once in the desired orientation, the user may operate the control 38 to thereafter relock the belt arm assembly 30 in the locked position to thereby utilize the operational aspects of the power tool 10.

Embodiments of the power tool 10 may further comprise the control 38 comprising a strong inner core 59 with a softer outer skin. The inner core 59 may be comprised of metals, alloys, or any combination thereof, to provide structural rigidity to the control 38. The control may also be configured to be a manual control, operable by manual input. The control 38 may be a quick-release trigger, where force applied to the point 57 may overcome the bias force of the biasing member 54 to disengage the engagement member 58 from the indentation 68 to allow free rotation of the belt arm assembly 30 about the extension 66. Embodiments of the power tool 10 may further comprise the control 38 being an automated control, operable by computer or electrical input.

Embodiments of the power tool 10 may further comprise the belt arm assembly 30 being directly coupled to the housing 20. Indeed, the housing 20 may be configured with a similar size, shape, and configuration as that of the gear casing 60, even the extension 66 of the gear casing 60, as described above, so that the belt arm assembly 30 could couple to, engage with, and function in a similar manner directly against the housing 20. For example, the housing 20 may include an extension and indentations similar to those described with respect to the gear casing 60, such that embodiments of the power tool 10 may comprise the belt arm assembly 30 being coupled directly to the housing 20 without the gear casing 60 positioned therebetween.

The materials of construction of the sander 10 and its various component parts, may be formed of any of many different types of materials or combinations thereof that can readily be formed into shaped objects provided that the components selected are consistent with the intended operation of power tools of the type disclosed herein. For example, and not limited thereto, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining the above-described sander 10 and its various component parts may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, 3-D printing, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A powered belt sander comprising:

a housing containing an internal motor configured to drive a shaft about a drive axis; and a belt arm having opposing rollers, each roller having a rotational axis, with an abrasive belt positioned thereon, one of the rollers comprising a drive roller operatively coupled to the shaft and the other roller positioned proximate a distal end of the belt arm, the abrasive belt being configured to translate about the rollers in response to input from the shaft, wherein the belt arm pivots about the drive axis to angle the belt arm at one of a stowed position and a plurality of working positions, wherein at the stowed position a line from the rotational axis of the drive roller to the rotational axis of the other roller is substantially parallel to a line between a first end and a second end of a grip portion of the housing, and at one or more of the plurality of working positions the line from the drive roller to the other roller is transverse to the line between the first end and the second end of the grip portion of the housing, wherein the belt arm is fixedly connected to an engagement member extending radially inwardly toward the drive axis, the engagement member releasably engaging one of a plurality of indentations such that when the engagement member engages any one of the indentations the belt arm is positioned at one of the stowed position and the plurality of working positions.

2. The powered belt sander of claim 1, wherein the drive roller is configured to receive the input from the shaft and thereby translate the abrasive belt.

3. The powered belt sander of claim 1, wherein each of the plurality of working positions is incrementally spaced from one another about the drive axis.

4. The powered belt sander of claim 1, wherein the belt arm is securable relative to the housing at each of the stowed position and the plurality of working positions.

5. The powered belt sander of claim 4, further comprising an input in operative communication with the belt arm and the housing to lock the belt arm relative to the housing.

6. The powered belt sander of claim 5, wherein the input is biased toward a locked position.

7. The powered belt sander of claim 6, wherein operation of the input releases the belt arm from the housing to thereby permit the belt arm to rotate about the drive axis.

8. A powered belt sander comprising:

a housing containing an internal motor configured to drive a shaft, the shaft having an axis;

a belt arm having a distal roller and a drive roller and an abrasive belt configured thereon, the drive roller being operatively coupled to the shaft, and the abrasive belt being configured to translate about the rollers in response to rotational input from the shaft;

wherein the belt arm pivots to angle the belt arm at one of a plurality of predetermined incremental positions with respect to the housing;

the belt arm further comprising a coupling member extending radially inward toward the shaft axis, the coupling member movable between a first position toward the shaft axis and a second position away from the shaft axis;

a plurality of coupling receivers in a fixed relationship to the housing, one coupling receiver corresponding to each of the plurality of predetermined incremental positions, each coupling receiver configured to receive the coupling member at the first position of the coupling member to thereby retain the belt arm at the respective predetermined incremental position.

9. The powered belt sander of claim 8, wherein the coupling member transitions between a locked and an unlocked position, wherein in the locked position the coupling member engages the respective coupling receiver and in the unlocked position the coupling member disengages from the plurality of coupling receivers.

10. The powered belt sander of claim 9, wherein the coupling member is biased in the locked position.

11. The powered belt sander of claim 9, further comprising a belt arm assembly, the belt arm assembly comprising the belt arm and the coupling member, the belt arm assembly being configured to rotate about the drive shaft with the coupling member in the unlocked position to pivot the belt arm.

12. The powered belt sander of claim 8, wherein the coupling receivers are configured on the housing.

13. The powered belt sander of claim 8, further comprising a gear case positioned axially between the housing and the belt arm, wherein the gear case comprises the coupling receivers and the belt arm assembly releasably couples to the gear case to thereby position the coupling member in operative communication with the coupling receivers.

14. A powered belt sander comprising:

a housing enclosing a motor;

a gear casing coupled to the housing, the gear casing surrounding one or more gears configured to receive rotational input from the motor to drive a shaft about a drive axis;

a belt arm assembly coupled to the gear housing and having a belt arm and a circulating abrasive belt, the circulating abrasive belt configured to translate about the shaft in response to rotational input from the shaft;

a plurality of incrementally spaced apart receivers on the gear casing; and an engagement member in operational communication with the belt arm assembly, the engagement member being movable in a generally radial direction to the drive axis between a locked position and an unlocked position, wherein in the locked position the engagement member engages one of the plurality of receivers to fix the belt arm assembly incrementally relative to the gear casing, and wherein in the unlocked position the belt arm assembly is free to rotate relative to the gear casing to thereby pivot the belt arm about the drive axis.

15. The powered belt sander of claim 14, wherein the engagement member is biased in the locked position.

16. The powered belt sander of claim 14, wherein the belt arm has a longitudinal axis which extends substantially orthogonally from the drive axis.

17. The powered belt sander of claim 14, wherein the belt arm assembly further comprises a throughbore having in interior flange, the throughbore housing a drive wheel that receives the rotational input from the shaft to drive the abrasive belt.

18. The powered belt sander of claim 17, wherein the flange comprises a first face that radially circumscribes at least a portion of the drive wheel and a second face substantially orthogonal to the first face and abutting the gear casing.

* * * * *